US009345080B2

(12) United States Patent
Kahlman et al.

(10) Patent No.: US 9,345,080 B2
(45) Date of Patent: May 17, 2016

(54) LED LIGHT SOURCE

(75) Inventors: Henricus Marius Joseph Maria Kahlman, Dongen (NL); Ralph Kurt, Eindhoven (NL); Haimin Tao, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/239,166

(22) PCT Filed: Aug. 21, 2012

(86) PCT No.: PCT/IB2012/054217

§ 371 (c)(1), (2), (4) Date: Feb. 17, 2014

(87) PCT Pub. No.: WO2013/027171

PCT Pub. Date: Feb. 28, 2013

(65) Prior Publication Data

US 2014/0197740 A1 Jul. 17, 2014

Related U.S. Application Data

(60) Provisional application No. 61/526,302, filed on Aug. 23, 2011.

(51) Int. Cl.
*H05B 33/08* (2006.01)

(52) U.S. Cl.
CPC ..... *H05B 33/0815* (2013.01); *H05B 33/083* (2013.01)

(58) Field of Classification Search
CPC ..... H05B 33/0815; H05B 33/083; H05B 33/0806; H05B 37/02
USPC ..... 315/121, 122, 91, 312, 185 S, 185 R, 315/294, 227
See application file for complete search history.

(56) References Cited

U.S. PATENT DOCUMENTS 7,081,722 B1 * 7/2006 Huynh et al. ..... 315/323
8,669,704 B2 * 3/2014 Marinus et al. ..... 315/35

(Continued)

FOREIGN PATENT DOCUMENTS

TW 201028033 A 7/2010
WO 2010038190 A1 4/2010

(Continued)

OTHER PUBLICATIONS

Citizen Electronics Co. Ltd, Development of LED lighting modules with built-in AC drive circuits capable of being driven directly by the general power supply (AC power source), Mar. 2, 2011.

*Primary Examiner* — Douglas W Owens
*Assistant Examiner* — Amy Yang

(57) ABSTRACT

A LED light source comprises a first rectifier (DB1) having input terminals coupled to an AC voltage source and output terminals connected by a first series arrangement comprising N LED loads and further comprises circuitry (I1, I2, I3, CC) for making the LED loads one by one carry a current when the momentary value of the AC voltage increases and one by one stop carrying a current when the momentary value of the AC voltage decreases. The LED light source also comprises a second rectifier (DB2) having input terminals coupled to the AC voltage source via a reactive element and output terminals connected by a second series arrangement comprising M LED loads and further comprises circuitry (I4) for making the LED loads one by one carry a current when the momentary value of the AC voltage present at the input terminals of the second rectifier increases and one by one stop carrying a current when the momentary value of the AC voltage decreases.

5 Claims, 6 Drawing Sheets

(56) References Cited

U.S. PATENT DOCUMENTS

| | | | | |
|---|---|---|---|---|
| 8,847,497 | B2 * | 9/2014 | Deppe | 315/121 |
| 2008/0116816 | A1 | 5/2008 | Neuman et al. | |
| 2011/0115389 | A1 | 5/2011 | Radermacher | |

FOREIGN PATENT DOCUMENTS

| | | | |
|---|---|---|---|
| WO | 2010067274 | A1 | 6/2010 |
| WO | 2010143239 | A1 | 12/2010 |
| WO | 2011070482 | A2 | 6/2011 |

* cited by examiner

LED LIGHT SOURCE

FIELD OF THE INVENTION

The invention relates to a cheap and simple LED light source comprising LED loads that is directly connectable to a supply source supplying a low frequency AC voltage such as the mains supply.

BACKGROUND OF THE INVENTION

Such a LED light source is known from U.S. Pat. No. 7,081,722. The LED loads are LED arrays comprising series arrangements and possibly parallel arrangements of individual LEDs. The LED light source comprises a rectifier for rectifying the low frequency AC voltage. In case the frequency of the low frequency AC voltage is f, a periodical DC voltage with a frequency 2f and a momentary amplitude varying between zero Volt and a maximum amplitude is present between the output terminals of the rectifier during operation. A series arrangement of the N LED loads is coupled between the output terminals of the rectifier. The LED light source is further equipped with control means for during half a period of the low frequency AC voltage subsequently making the LED loads carry a current, one by one and in dependency of the momentary amplitude of the low frequency AC supply voltage when the amplitude increases and for subsequently making the LED loads stop carrying a current, one by one and in dependency of the momentary amplitude of the low frequency AC supply voltage when the momentary amplitude decreases.

When the momentary amplitude of the periodical DC voltage is zero Volt, none of the LED loads carries a current. When the momentary amplitude of the periodical DC voltage increases, a voltage is reached at which the first LED load starts carrying a current. Similarly, when the amplitude of the periodical DC voltage has increased further to a high enough value, the second LED load starts conducting. Upon further increase of the amplitude of the periodical DC voltage, the remaining LED loads start subsequently to carry a current.

When all of the LED loads carry a current, the momentary amplitude of the periodical DC voltage increases further until the maximum amplitude is reached. After that, the momentary amplitude of the periodical DC voltage starts decreasing. While the momentary amplitude decreases, the LED loads stop conducting a current one by one. After the first LED load has stopped conducting, the momentary amplitude of the periodical DC current decreases further to zero and then the cycle described here-above is repeated.

The known LED light source is very compact and comparatively simple. Furthermore, it can be directly supplied from a low frequency AC supply voltage source such as the mains supply. A disadvantage of the known LED light source is that in the vicinity of the zero crossings of the low frequency AC voltage no light is generated by the LED light source. It is desirable to prevent these light gaps and to thereby prevent stroboscopic effects. A possible solution to this problem is to make use of a "fill in capacitor". This capacitor is charged in each half period, when the magnitude of the mains voltage is comparatively high and supplies a current to the LED loads when the magnitude of the mains voltage is very low. As a consequence the LED light source generates light continuously. However, a relatively big capacitor is needed, which is undesirable when a flat LED light source is required. Furthermore at least one switching element and a control circuit for controlling the charging and discharging of the capacitor are needed.

SUMMARY OF THE INVENTION

It is an object of the invention to provide a LED light source, that generates light continuously without light gaps, can be made compatible with a phase cut dimmer and can be very flat.

The invention is defined by the independent claims. The dependent claims define advantageous embodiments.

One aspect of the invention provides a LED light source comprising a first rectifier having input terminals coupled to an AC voltage source and output terminals connected by a first series arrangement comprising N LED loads and further comprising circuitry for making the LED loads one by one carry a current when the momentary value of the AC voltage increases and one by one stop carrying a current when the momentary value of the AC voltage decreases. The LED light source also comprises a second rectifier having input terminals coupled to the AC voltage source via a reactive element and output terminals connected by a second series arrangement comprising M LED loads and further comprising circuitry for making the LED loads one by one carry a current when the momentary value of the AC voltage present at the input terminals of the second rectifier increases and one by one stop carrying a current when the momentary value of the AC voltage decreases.

According to an aspect of the present invention LED light source is provided comprising

- a first circuit input terminal and a second circuit input terminal for connection to a supply voltage source supplying a low frequency AC supply voltage with frequency f,
- a first rectifier equipped with a first input terminal coupled to the first circuit input terminal and a second input terminal coupled to the second circuit input terminal,
- a first series arrangement comprising N LED loads, a first and second end of said first series arrangement being coupled to a first output terminal and a second output terminal of the first rectifier respectively, wherein N is an integer,
- first control means for during half a period of the low frequency AC voltage subsequently making the LED loads comprised in the first series arrangement carry a current, one by one and in dependency of the momentary amplitude of the low frequency AC supply voltage when the momentary amplitude increases and for subsequently making the LED loads stop carrying a current, one by one, and in dependency of the momentary amplitude of the low frequency AC supply voltage when the momentary amplitude decreases,
- a second rectifier equipped with a first input terminal coupled to the first circuit input terminals via a reactive element and a second input terminal coupled to the second circuit input terminal,
- a second series arrangement comprising M LED loads, a first and second end of said second series arrangement being coupled to a first output terminal and a second output terminal of the second rectifier respectively, wherein M is an integer, and
- second control means for, during a period of the rectified AC voltage present between the output terminals of the second rectifier, subsequently making the LED loads comprised in the second series arrangement carry a current, one by one and in dependency of the momentary amplitude of the rectified AC voltage when the momentary amplitude increases and for subsequently making the LED loads stop carrying a current, one by one, and in dependency of the momentary amplitude of the rectified AC voltage when the momentary amplitude decreases.

Since the reactive element causes a phase shift between the currents carried by the first series arrangement of LED loads and the second series arrangement of LED loads, at any moment in time at least one or more LED loads in one of the series arrangements carries a current and therefore generates light. The stroboscopic effect is thus prevented. Since a bulky capacitor can be dispensed with, it is also possible to make the LED light source very flat in case such is desirable. Furthermore, the LED light source according to the invention can be made compatible with phase cut dimmers and has a comparatively high power factor. It was also found that the flicker index and the THD of a LED light source according to the invention are low, while the efficiency is high. The fact that an electrolytic capacitor can be dispensed with has a favourable effect on the life time of the LED light source. It is noted that both N and M may be equal to 1. Good results have been obtained for embodiments wherein N=1 and M>1 and for embodiments wherein M=1 and N>1. Good results have also been obtained for embodiments wherein N and M are both bigger than 1.

According to another aspect of the invention a method is provided for operating a LED light source equipped with a first series arrangement comprising N LED loads and a second series arrangement comprising M LED loads, comprising the steps of providing an AC supply voltage with frequency f, rectifying the AC supply voltage by means of a first rectifier, and supplying the rectified AC voltage to the series arrangement comprising N LED loads, during a period of the rectified AC supply voltage subsequently making the LED loads carry a current, one by one, in dependency of the momentary amplitude of the rectified AC supply voltage, when the momentary amplitude increases, and subsequently making the LED loads stop carrying a current, in dependency of the momentary amplitude of the rectified AC supply voltage, when the momentary amplitude decreases, and also the simultaneous steps of providing the AC supply voltage with frequency f to a second rectifier via a reactive element, rectifying the AC voltage present at the input of the second rectifier, and supplying the rectified AC voltage present between output terminals of the second rectifier to the series arrangement comprising M LED loads, during a period of the rectified AC voltage, subsequently making the LED loads carry a current, one by one, in dependency of the momentary amplitude of the rectified AC voltage, when the momentary amplitude increases, and subsequently making the LED loads stop carrying a current, in dependency of the momentary amplitude of the rectified AC voltage, when the momentary amplitude decreases.

Further elaborations of the invention are mentioned in the dependent claims.

BRIEF DESCRIPTION OF THE DRAWINGS

Embodiments of a LED light source according to the invention will be further described making use of a drawing.

In the drawing.

DESCRIPTION OF EMBODIMENTS

Figure 1A:
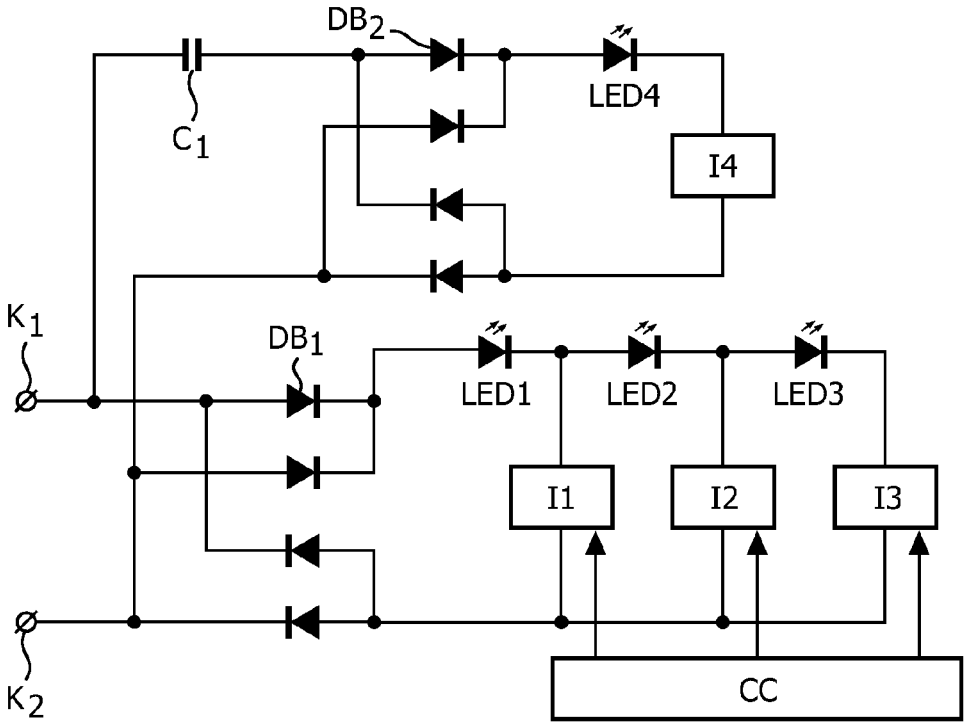
FIG. 1 shows a schematic representation of three embodiments of a LED light source according to the invention.

In FIG. 1*a*, K1 and K2 are first and second circuit input terminals for connection to a low frequency AC voltage source such as the european or american mains supply. Circuit input terminals K1 and K2 are connected to respective input terminals of a diode bridge DB1. A first output terminal of diode bridge DB1 is connected to a second output terminal of diode bridge DB1 by means of a series arrangement of three LED loads LED1, LED2 and LED3 and a current source I3 respectively.

The LED loads are LED arrays comprising series arrangements and possibly parallel arrangements of individual LEDs. A cathode of LED load LED1 is connected to the second output terminal of diode bridge DB1 by means of a controllable current source I1 and a cathode of LED load LED2 is connected to the second output terminal of diode bridge DB1 by means of a controllable current source I2. Control circuit CC is coupled to the controllable current sources I1 and I2. A capacitor C1 is coupled between the first circuit input terminal K1 and a first input terminal of a second diode bridge DB2. Second circuit input terminal K2 is coupled to a second input terminal of the second diode bridge DB2. Output terminals of diode bridge DB2 are connected by means of a series arrangement of a LED load LED4 and a current source I4.

The operation of the LED light source shown in FIG. 1*a* is as follows.

When input terminals K1 and K2 are connected to a low frequency AC supply voltage source, the low frequency AC supply voltage supplied by the low frequency AC supply voltage source is rectified by the diode bridge DB1 so that a rectified AC voltage is present between the output terminals of diode bridge DB1. In each period of this rectified AC voltage the voltage present between the output terminals increases from zero Volt to a maximum amplitude during the first half period. When the voltage reaches the forward voltage of LED load LED1, a current starts flowing through LED load LED1 and current source I1. When the voltage increases further and reaches the sum of the forward voltages of LED load LED1 and LED load LED2, a current starts flowing through LED loads LED1 and LED2 and the current source I2. To prevent a high power dissipation, the current source I1 is switched off by the control circuit CC. Upon a further increase of the voltage, when it reaches a value that equals the forward voltages of LED loads LED1, LED2 and LED3, a current starts flowing through the LED loads LED1, LED2 and LED3 and current source I3. Current source I2 is switched off by the control circuit CC to prevent a high power dissipation. During the second half of the period of the rectified AC voltage the voltage decreases. When the voltage has decreased to a value that is lower than the sum of the forward voltages of the three LED loads, LED load LED3 stops conducting a current and the control circuit switches current source I2 on again, so that a current flows through the LED loads LED1 and LED2 and current source I2. When the voltage decreases further and is lower than the sum of the forward voltages of LED loads LED1 and LED2, current source I1 is switched on by the control circuit CC and LED load LED2 stops conducting a current. Consequently, a current flows through LED load LED1 and current source I1, until the voltage drops below the forward voltage of LED load LED1, so that also LED load LED1 stops carrying a current. This sequence is repeated during each subsequent period of the rectified AC voltage. As a consequence, the current through the LED loads is a periodical DC current that drops to zero in the vicinity of the zero crossings of the AC supply voltage.

At the input terminals of the second diode bridge a low frequency AC voltage is present that is phase shifted with respect to the low frequency AC voltage supplied by the low frequency AC supply voltage source. This phase shift is caused by capacitor C1. As a consequence the rectified AC voltage that is present between the output terminals of diode bridge DB2 is also phase shifted with respect to the rectified AC voltage that is present between the output terminals of diode bridge DB1. In each period of the rectified AC voltage that is present between the output terminals of diode bridge DB2, further referred to as second rectified AC voltage, the series arrangement of LED load LED4 and current source I4 carries a current as long as the second rectified AC voltage is higher than the forward voltage of LED load LED4. The current through LED load LED4 thus is a periodical DC current that drops to zero when the second rectified AC voltage is lower than the forward voltage of LED load LED4.

The capacitor C1 is dimensioned to effect such a phase shift between the current through LED loads LED1, LED2 and LED3 on the one hand and the current through LED load LED4 on the other hand, that a time lapse in which the first current has magnitude zero, never overlaps with a time lapse in which the second current has magnitude zero. As a consequence, at any moment in time at least part of the LED loads generate light so that there are no light gaps and stroboscopic effects are avoided.

Figure 1B:
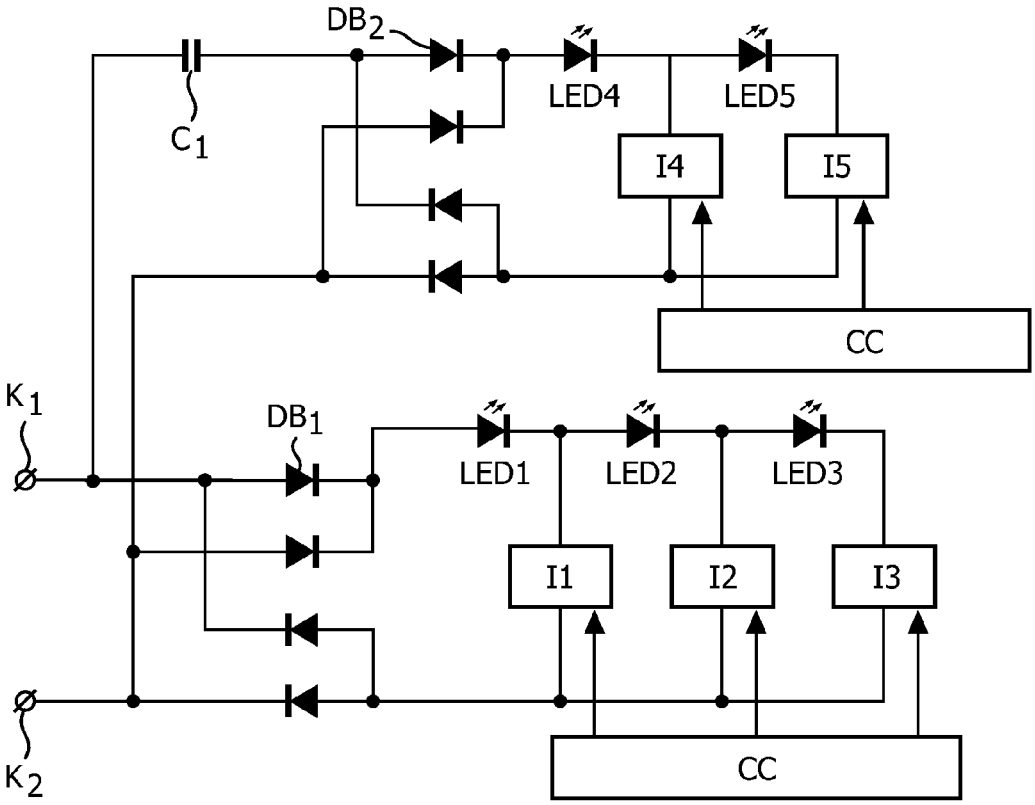

In FIG. 1B components and circuit parts similar to those in FIG. 1A have the same reference number. In FIG. 1B M equals 2, so that an additional LED load LED5 and an current source I5 are present in the circuitry connected to the output terminals of the second rectifier DB2. The operation of this circuitry is analogous to the operation of the circuitry connected to the output terminals of the first rectifier DB1: When the rectified AC voltage present between the output terminals of the second rectifier increases, LED loads LED4 and LED5 subsequently start carrying a current. When the rectified AC voltage decreases LED load LED5 and LED load LED4 subsequently stop carrying a current. Also in the embodiment of FIG. 1B the phase shift between the current through LED loads LED1, LED2 and LED3 on the one hand and the current through LED loads LED4 and LED5 on the other hand makes sure that at any moment in time at least part of the LED loads generate light so that there are no light gaps and stroboscopic effects are avoided.

Figure 1C:
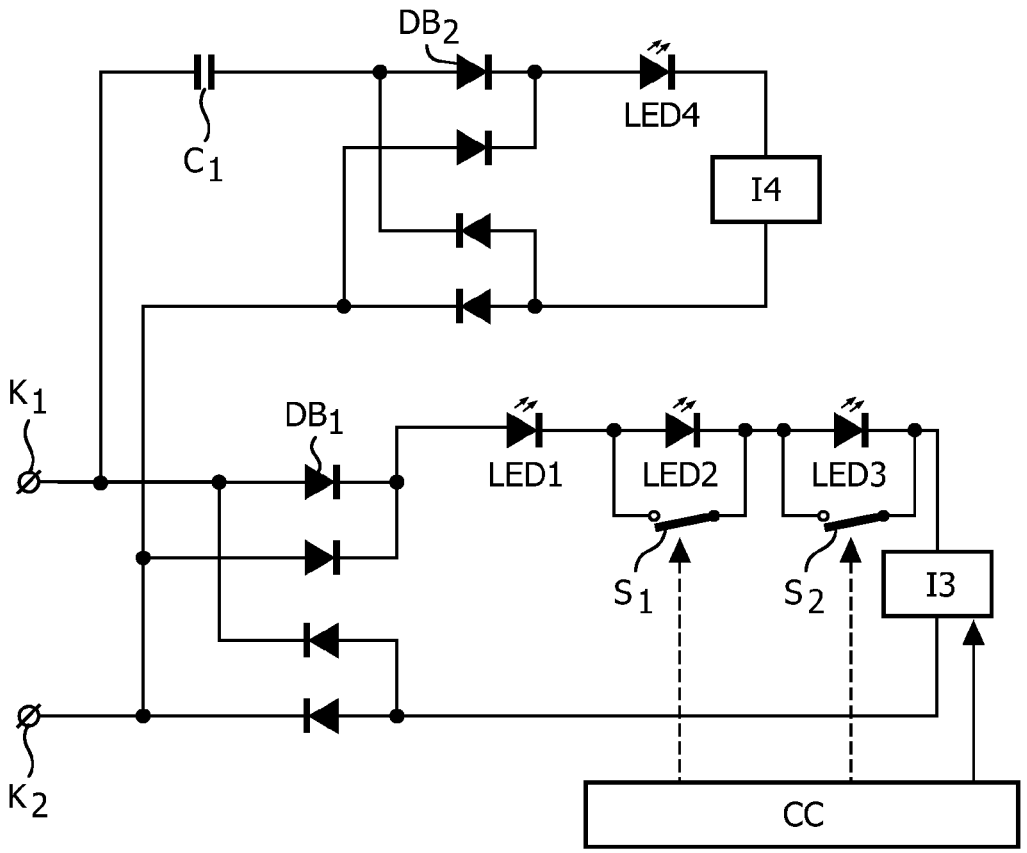

In FIG. 1C components and circuit parts similar to those in FIG. 1A have the same reference number. It can be seen that current sources I1 and I2 are dispensed with in the embodiment in FIG. 1B and that LED loads LED2 and LED3 are shunted by switches S1 and S2 respectively. Control electrodes of these switches are coupled to control circuit CC.

The operation of the LED light source in FIG. 1B is very similar to that shown in FIG. 1A.

During a first time lapse of each period of the rectified AC voltage present between the output terminals of diode bridge DB1, the control circuit controls the switches S1 and S2 both in the conductive state. When the voltage equals the forward voltage of LED load LED1, a current starts flowing through LED load LED1, switch S1, switch S2 and current source I3. When the voltage equals the sum of the forward voltages of LED loads LED1 and LED2, switch S1 is rendered nonconductive by the control circuit CC, and a current starts to flow through LED loads LED1, LED load LED2, switch S2 and current source I3. When the voltage has increased further and equals the sum of the forward voltages of LED loads LED1, LED2 and LED3, switch S2 is rendered nonconductive by the control circuit CC and a current flows through the three LED loads LED1, LED2 and LED3. When the voltage drops during the second half of a period of the rectified AC voltage, present between the output terminals of rectifier DB1, LED loads LED3 and LED2 stop conducting in that order and switches S2 and S1 are rendered conductive again in that order. LED load LED 1 stops conducting when the voltage becomes lower than the forward voltage of LED load LED1. The current through the LED loads LED1, LED2 and LED3 is similar to the current through these LED loads in the embodiment shown in FIG. 1A. Also the current through the LED load LED4 is similar to the current through LED load LED4 in the embodiment shown in FIG. 1A and is phase shifted with respect to the current through LED loads LED1, LED2 and LED3 by capacitor C1. As a consequence also in the light generated by the LED light source shown in FIG. 1C there are no light gaps and stroboscopic effects are avoided. It is remarked that in case each of the LED loads LED1-LED3 were shunted by a switch controlled by control circuit CC, it would be possible to render the LED loads conducting and non-conducting in arbitrary order.

Figure 2:
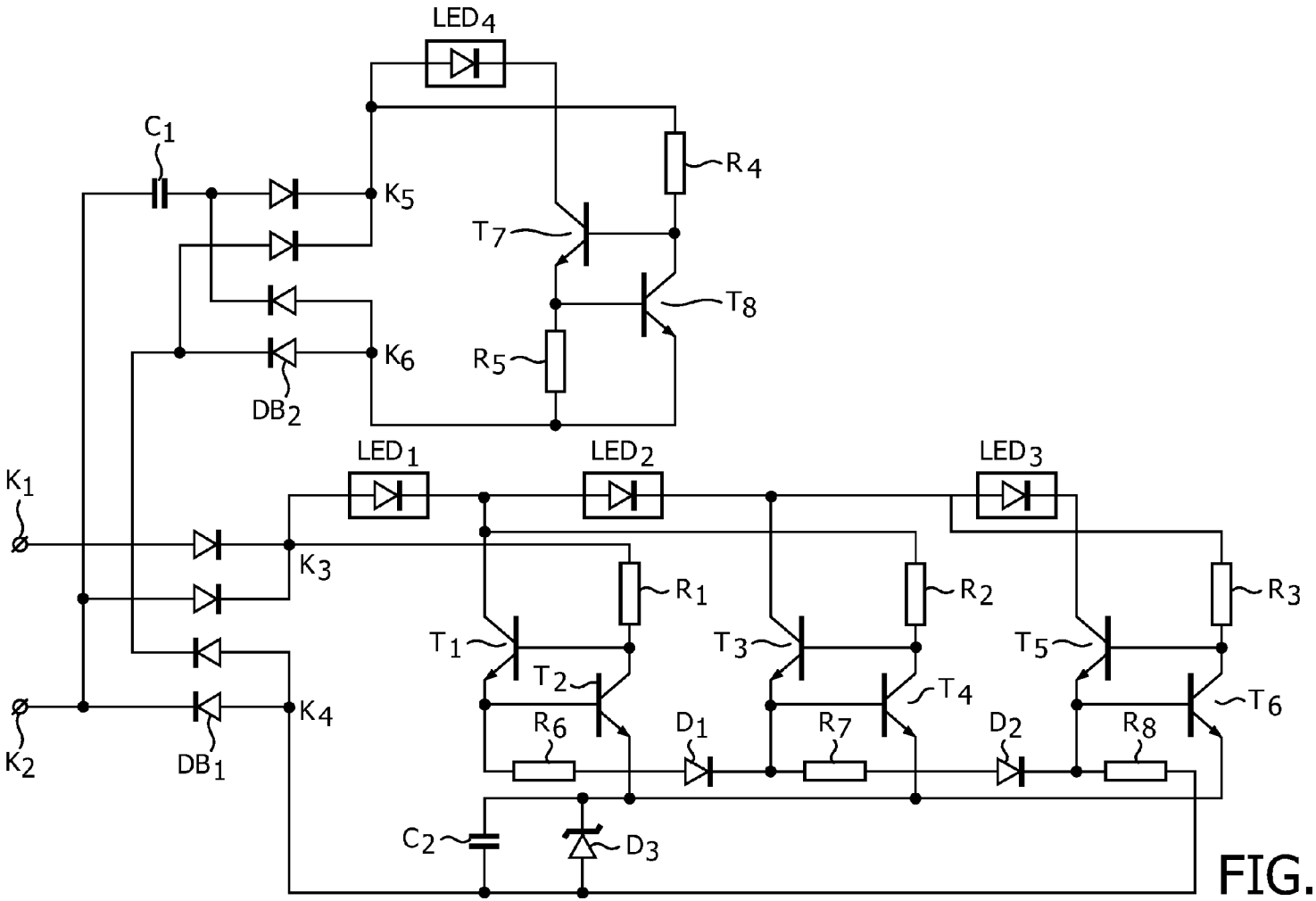
FIG. 2 shows the embodiment of FIG. 1*a* in somewhat more detail.

The LED light source shown in FIG. 2 corresponds to that shown in FIG. 1A, but the current sources and the control circuit are shown in more detail. Components and circuit parts that are similar to the ones shown in FIG. 1A have the same reference number. K3 and K4 are first and second output terminals of diode bridge DB1. The first output terminal K3 is connected to the second output terminal K4 by means of a series arrangement of LED load LED1, transistor T1, resistor R6, diode D1, resistor R7, diode D2 and resistor R8. The first output terminal K3 is also connected to the second output terminal K4 by means of a series arrangement of a resistor R1, transistor T2 and capacitor C2. Capacitor C2 is shunted by Zener diode D3. The base of transistor T1 is connected to a common terminal of resistor R1 and transistor T2. A common terminal of transistor T1 and resistor R6 is connected to the base of transistor T2. A transistor T3 connects a cathode of LED load LED2 and a common terminal of diode D1 and resistor R7. A cathode of LED load LED1 is connected to a common terminal of transistor T2 and capacitor C2 by means of a series arrangement of a resistor R2 and a transistor T4. A base electrode of transistor T3 is connected to a common terminal of resistor R2 and transistor T4. The base of transistor T4 is connected to a common terminal of diode D1 and resistor R7. The cathode of LED load LED3 is connected to a common terminal of diode D2 and resistor R8 by means of a transistor T5. The cathode of LED load LED2 is connected to the common terminal of transistor T2 and capacitor C2 by means of a series arrangement of resistor R3 and transistor T6. A base of transistor T5 is connected to a common terminal of resistor R3 and transistor T6. A base of transistor T6 is connected to a common terminal of diode D2 and resistor R8.

K5 and K6 are first and second output terminals of diode bridge DB2 respectively. A current source is formed by transistor T7. Transistor T8 and resistors R4 and R5 together form circuitry to adjust the magnitude of the current through transistor T7. A cathode of LED load LED4 is connected to second output terminal K6 by means of a series arrangement of transistor T7 and resistor R5. First output terminal K5 is connected to second output terminal K6 by means of a series arrangement resistor R4 and transistor T8. A base of transistor T7 is connected to a common terminal of resistor R4 and transistor T8. A base of transistor T8 is connected to a common terminal of transistor T7 and resistor R5.

In FIG. 2 transistors T1, T3, T5 and T7 act as current sources, all the other components, apart from the diode bridges DB1 and DB2 and the capacitor C1, together form a control circuit for controlling the current sources, i.e. the transistors T1, T3, T5 and T7.

The operation of the LED light source shown in FIG. 2 is as follows.

During operation a rectified AC voltage is present between first and second output terminals K3 and K4 of diode bridge DB1. At the beginning of each period of the rectified AC voltage, the momentary magnitude of the voltage is zero and subsequently starts to increase. This causes a current to flow from first output terminal K3 through resistor R1, the base-emitter junction of transistor T1, resistor R6, diode D1, resistor R7, diode D2 and resistor R8 to second output terminal K4. This current renders transistor T1 conductive, so that when the momentary value of the rectified voltage is higher than the forward voltage of LED load LED1, a current starts flowing from first output terminal K3, through LED load LED1, transistor T1, resistor R6, diode D1, resistor R7, diode D2 and resistor R8 to second output terminal K4. This current causes the voltage across resistor R6, diode D1, resistor R7, diode D2 and resistor R8 to increase and thereby render transistor T2 conductive. As a consequence part of the current flowing from first output terminal K3 through resistor R1 flows through transistor T2 instead of through the base-emitter junction of transistor T1, so that the current flowing through transistor T1 is thereby decreased. A balance is reached between the currents carried by transistors T1 and T2, so that the current through transistor T1 is adjusted to a substantially constant value and transistor T1 acts as a current source. This substantially constant value is determined by the voltage across Zener diode D3, since the voltage across resistor R6, diode D1, resistor R7, diode D2 and resistor R8 equals sum of the voltage across the base-emitter junction of transistor T2 and the voltage across Zener diode D3.

When the momentary magnitude of the rectified AC voltage is higher than the forward voltage of LED load LED1, a current starts flowing from first output terminal K3 through LED load LED1, resistor R2, the base-emitter junction of transistor T3, resistor R7, diode D2 and resistor R8 to second output terminal K4. This current renders transistor T3 conductive. When the momentary value of the rectified AC voltage increases further and becomes higher than the sum of the forward voltages of LED loads LED1 and LED2, a current starts flowing from first output terminal K3, through LED loads LED1 and LED2, transistor T3, resistor R7, diode D2 and resistor R8. This current causes the voltage across resistor R7, diode D2 and resistor R8 to increase and thereby renders transistor T4 conductive. As a consequence part of the current flowing from first output terminal K3 through resistor R2 flows through transistor T4 instead of through the base-emitter junction of transistor T3, so that thereby a balance is reached between the currents carried by transistors T3 and T4. The current through transistor T3 is thus adjusted to a substantially constant value so that transistor T3 acts as a current source. This substantially constant value is determined by the voltage across Zener diode D3, since the voltage across resistor R7, diode D2 and resistor R8 equals the sum of the voltage across the base-emitter junction of transistor T4 and the voltage across Zener diode D3. Because resistor R6 and diode D1 are not in the current path of the current through T3, the current through LED loads LED1 and LED2 and transistor T3 has a higher value than the current through LED load LED1 and transistor T1 before LED load LED2 started to conduct a current.

This higher value of the current is often referred to as "current stacking". When the second LED load LED2 conducts a current, the currents through transistors T1 and T2 become substantially zero. This can be explained as follows: when it is assumed that both transistor T1 and transistor T3 are conductive, also transistors T2 and T4 are conductive and the emitter of T1 is at a voltage that is the sum of the Zener voltage of Zener diode D3 and base-emitter voltage of transistor T2 (=0.7 V). The emitter of transistor T3 is at a voltage that equals the sum of the Zener voltage of Zener diode D3 and the base-emitter voltage of transistor T4 (=0.7 V). In other words the voltage at the emitter of transistor T1 is substantially equal to the voltage at the emitter of transistor T3 and thus there is substantially no voltage drop across resistor R6 and diode D7. The current through resistor R6 and therefore the currents through transistors T1 and T2 is substantially zero. This effect is called pinching off.

When the momentary magnitude of the rectified AC voltage is higher than the sum of the forward voltages of LED load LED1 and LED load LED2, a current starts flowing from first output terminal K3 through LED loads LED1 and LED2, resistor R3, the base-emitter junction of transistor T5 and resistor R8 to second output terminal K4. This current renders transistor T5 conductive. When the momentary value of the rectified AC voltage increases further and becomes higher than the sum of the forward voltages of LED loads LED1, LED2 and LED3, a current starts flowing from first output terminal K3, through LED loads LED1, LED2 and LED3, transistor T5 and resistor R8. This current causes the voltage across resistor R8 to increase and thereby renders transistor T6 conductive. As a consequence part of the current flowing from first output terminal K3 through resistor R3 flows through transistor T6 instead of through the base-emitter junction of transistor T5, so that a balance is reached between the currents carried by transistors T5 and T6 and the current through transistor T5 is thus adjusted to a substantially constant value so that transistor T5 acts as a current source. This substantially constant value is determined by the voltage across Zener diode D3, since the voltage across resistor R8 equals sum of the voltage across the base-emitter junction of transistor T6 and the voltage across Zener diode D3. Because resistor R7 and diode D2 are not in the current path of the current through T5, the current through LED loads LED1, LED2, LED3 and transistor T5 has a higher value than the current through LED loads LED1 and LED2 and transistor T3 before LED load LED3 started to conduct a current.

Via current pinching, explained here-above, the currents through transistors T3 and T4 become substantially zero when the third LED load LED3 conducts a current.

When the rectified AC voltage present between the first and second output terminals K3 and K4 starts to decrease and its momentary value becomes lower than the sum of the forward voltages of the LED loads LED1, LED2 and LED3, LED load LED3 and transistors T5 and T6 stop conducting a current. As a consequence, the pinch off effect no longer prevents transistors T3 and T4 from conducting current, so that both T3 and T4 become once more conductive in the same way as described hereabove, when the momentary value of the rectified AC voltage was still increasing. Again a balance installs between the current through transistor T3 and the current through transistor T4 so that transistor T3 acts as a current source carrying a substantially constant current. In this stage of the operation of the LED light source the current through transistors T1 and T2 is still substantially zero. However, when the momentary value of the rectified AC voltage becomes lower than the sum of the forward voltages of LED loads LED1 and LED2, LED load LED2 and transistors T3 and T4 stop conducting a current. Consequently, the pinch off effect no longer prevents transistors T1 and T2 from conducting current, so that both T3 and T4 become once more conductive in the same way as described hereabove. Again a balance installs between the current through transistor T1 and the current through transistor T2 so that transistor T1 acts as a current source carrying a substantially constant current. The currents subsequently carried by transistor T3 and transistor T1 are equal to the currents carried by these transistors when the momentary value of the rectified AC voltage was still increasing.

Between first and second output terminals K5 and K6 of diode bridge DB2 the second rectified AC voltage is present. At the beginning of a period of the second rectified AC voltage the momentary value of the voltage is zero and subsequently starts to increase. As a consequence a current starts to flow from first output terminal K5 through R4 and a base-emitter junction of transistor T7 and resistor R5 to second output terminal K6. When the momentary value of the second rectified AC voltage exceeds the forward voltage of LED load LED4, LED load LED4 starts to conduct, thereby increasing the voltage across resistor R5 so that also transistor T8 becomes conductive. A balance installs between the currents through transistors T7 and T8, so that transistor T7 carries a substantially constant current and thus acts as a current source. When the momentary value of the second rectified AC voltage drops below the forward voltage of LED load LED4, LED load LED4 and transistors T7 and T8 stop carrying a current.

Figure 3:
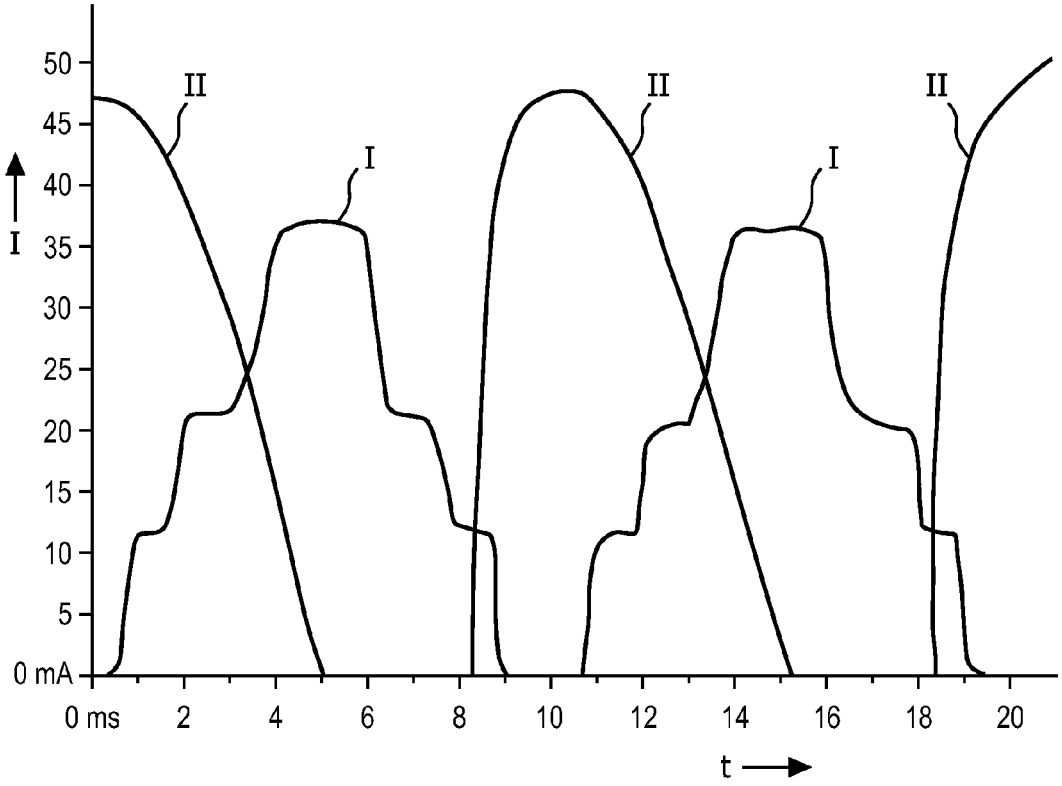
FIG. 3 shows the shape of currents in the embodiment shown in FIG. 2 as a function of time.

FIG. 3 shows the current flowing through the LED loads LED1, LED2 and LED3 (curve I) and the current flowing through the LED load LED4 (curve II) as a function of time. Because of the presence of capacitor C1, the phase shift between these currents is such that at any moment in time at least one LED load carries a current so that light gaps are absent and stroboscopic effects are prevented.

Figure 4:
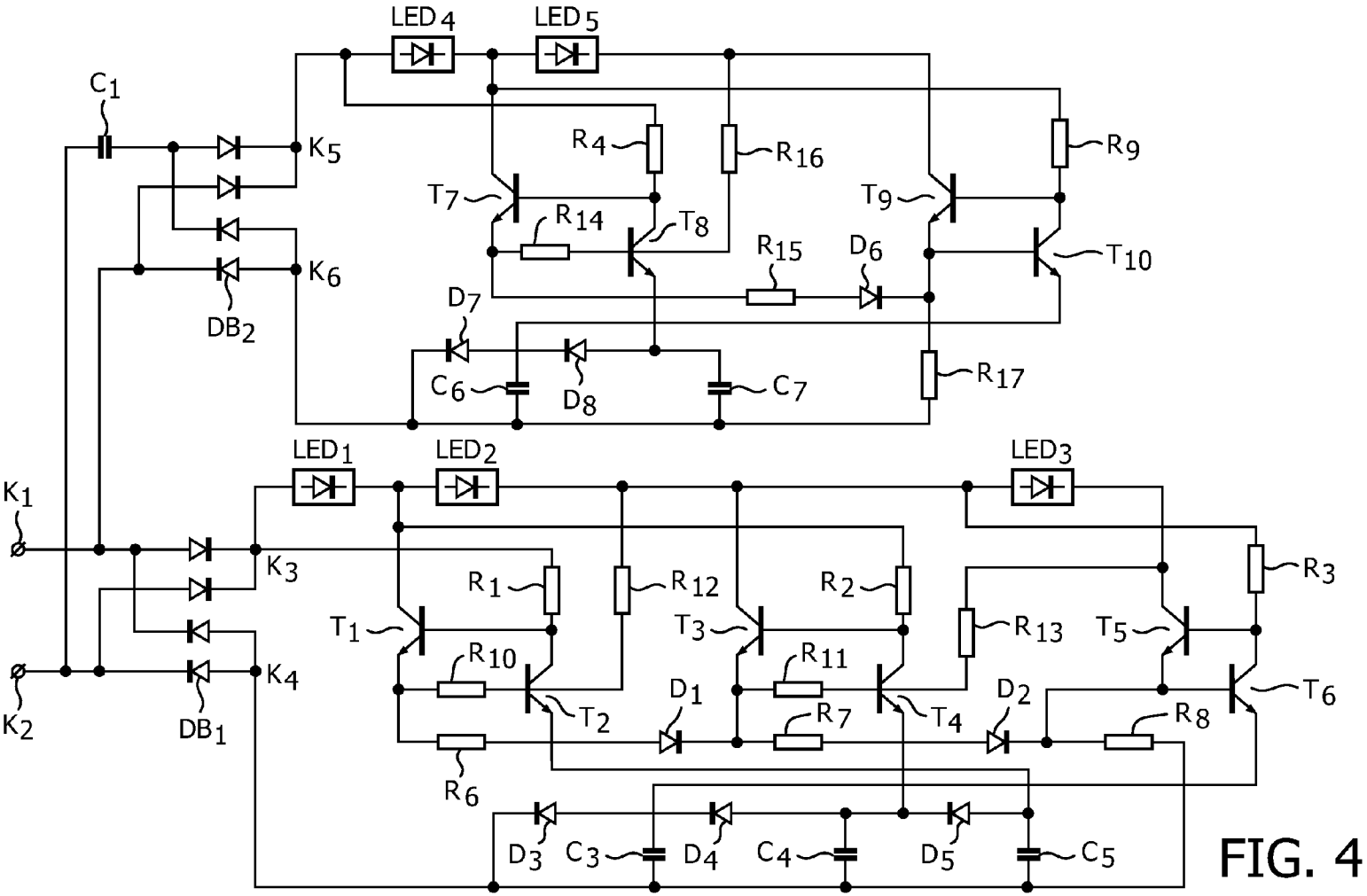
FIG. 4 shows another embodiment of a LED light source according to the invention.

In the embodiment shown in FIG. 4, components and circuit parts that are similar to those of the embodiment shown in FIG. 2 have the same reference number. As in the embodiment shown in FIG. 2, three LED loads LED1, LED2 and LED3 are supplied by the rectified AC voltage that is present between the output terminals K3 and K4 of first diode bridge DB1. Also the circuitry connected to the output terminals K3 and K4 is very similar to that connected to the output terminals K3 and K4 in FIG. 2. Differences are first of all the presence of resistor R12 connecting the cathode of LED load LED2 to the base electrode of transistor T2 and resistor R13 connecting the cathode of LED load LED3 to the base of transistor T4. When LED load LED2 has become conductive, a current flows from the cathode of LED load LED2 through resistor R12 to the base of transistor T2. Transistor T2 is thereby rendered fully conductive so that transistor T1 becomes non-conductive. Resistor R12 thus provides a mechanism for making transistor T1 non-conductive in addition to the pinching off mechanism discussed here-above for the embodiment in FIG. 2. In a similar way current flows from the cathode of LED load LED3 through resistor R13 to the base of transistor T4 when LED load LED3 has become conductive, so that transistor T4 becomes fully conductive and transistor T3 is rendered non-conductive thereby. A further difference is the presence of resistor R10 between the emitter of transistor T1 and the base of transistor T2 and of resistor R11 between the emitter of transistor T3 and the base of transistor T4. These are placed to prevent the current through resistor R12 to flow away from the base-emitter junction of transistor T2 instead of into it and to prevent the current through resistor R13 to flow away from the base-emitter junction of transistor T4 instead of into it. The last difference is that Zener diode D3 and capacitor C2 are replaced by diodes D3, D4 and D5 and capacitors C3, C4 and C5. A series arrangement of diodes D5, D4 and D3 is connected between transistor T2 and output terminal K4. The emitter of transistor T4 is connected to a common terminal of diode D5 and diode D4. The emitter of transistor T6 is connected to a common terminal of diode D4 and diode D3. Anodes of diodes D5, D4 and D3 are connected to output terminal K4 by means of capacitor C5, capacitor C4 and capacitor C3 respectively. In the embodiment of FIG. 2, the emitters of transistors T2, T4 and T6, when they are conductive, are all maintained at the Zener voltage of Zener diode D3. However, in the embodiment of FIG. 4 the emitters of transistors T2, T4 and T6, when they are conductive, are maintained at the voltage across the series arrangement of diodes D5, D4 and D3, the voltage across the series arrangement of diodes D4 and D3 and the voltage across diode D3 respectively. For any given voltage present at the base of transistor T2, T4 or T6 the transistor conducts more current when the voltage at its emitter is lower. As a consequence, when the embodiment in FIG. 4 is compared with a reference embodiment only differing in that the voltage at the emitter of each of the switches T2, T4 and T6 is the same and equals the voltage across three diodes in series, the current through transistor T2 would be the same in both embodiments and therefore the same is true for the current through transistor T1. However, in the embodiment shown in FIG. 4, the current through transistor T4 is increased with respect to the current through transistor T4 in the reference embodiment and the current through T6 is even further increased with respect to the current through T6 in the reference embodiment. Since transistors T1, T3 and T5, when they are conducting a current, are in balance with transistors T2, T4 and T6 respectively, the diodes D3-D5 thus cause a decrease in the current through transistor T3 and a bigger decrease in the current through T5 with respect to the current through T3 and T5 in the reference embodiment. The diodes D3, D4 an D5 thus counteract to some extent the effect of "current stacking". The modulation depth of the current is in this way reduced so that the power factor is increased and the THD is decreased. The maintenance of the LED loads is also improved. The function of the capacitors C3, C4 and C5 is to act as a filter for removing noise and spikes.

In the embodiment shown in FIG. 4, the diodes D3, D4 and D5 cause the voltages at the emitters of transistors T1, T3 and T5 to be unequal, when they are conducting. As a consequence the pinching off mechanism is not capable of switching for instance transistor T1 completely off, when LED load LED2 and transistor T3 carry a current. As explained hereabove the resistors R10, R11, R12 and R13 take care of switching off transistor T1 and transistor T3.

In the embodiment shown in FIG. 4, two LED loads LED4 and LED5 are supplied by the second rectified AC voltage that is present between output terminals K5 and K6 of second diode bridge DB2.

The circuitry for controlling the currents through these two LED loads LED4 and LED5 is completely analogous to that for controlling the current through LED loads LED1, LED2 and LED3. Transistor T7 is a first current source that carries current when only LED load LED4 is conductive and transistor T9 is a second current source that carries current in case both LED loads LED4 and LED5 carry a current. The remainder of the circuitry controls the current through transistor T7 and T9 respectively as explained in the description of the operation of the circuitry comprised in the embodiment of FIG. 2 and the circuitry for supplying LED loads LED1, LED2 and LED3 connected to the output terminals K3 and K4 in the embodiment of FIG. 4. Like diodes D3, D4 and D5, diodes D7 and D8 decrease the modulation depth of the current caused by current stacking.

Figure 5:
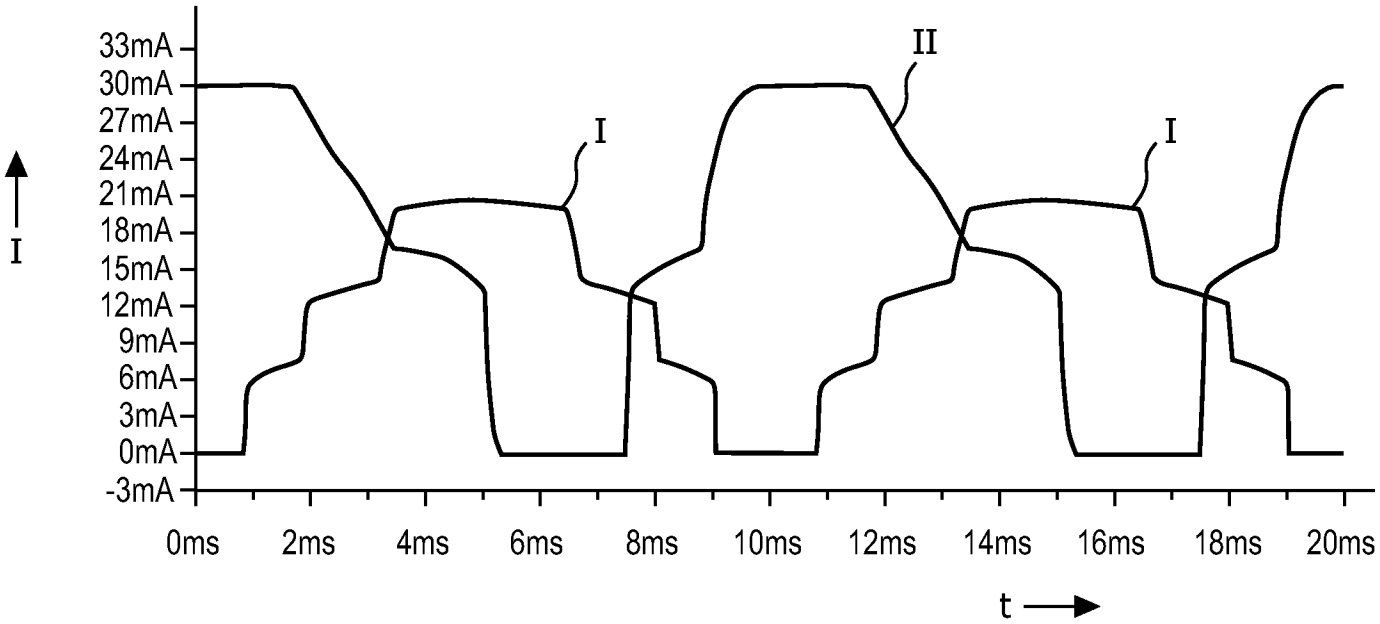
FIG. 5 shows the shape of currents in the embodiment shown in FIG. 4 as a function of time.

FIG. 5 shows the current flowing through the LED loads LED1, LED2 and LED3 (curve I) and the current flowing through the LED loads LED4 and LED5 (curve II) as a function of time. Because of the presence of capacitor C1, the phase shift between these currents is such that at any moment in time at least one LED load carries a current so that light gaps are absent and stroboscopic effects are prevented.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. The invention may be implemented by means of hardware comprising several distinct elements, and/or by means of a suitably programmed processor. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. An LED light source comprising:

a first circuit input terminal and a second circuit input terminal for connection to a supply voltage source supplying an AC supply voltage with frequency f, a first rectifier equipped with a first input terminal coupled to the first circuit input terminal and a second input terminal coupled to the second circuit input terminal, a first series arrangement comprising N LED loads, a first and second end of said first series arrangement being coupled to a first output terminal and a second output terminal of the first rectifier respectively, wherein N is an integer greater than one, a first controller for, during a period of the rectified AC supply voltage subsequently making the LED loads comprised in the first series arrangement carry a current, one by one and in dependency of the momentary amplitude of the rectified AC supply voltage when the momentary amplitude increases and for subsequently making the LED loads comprised in the first series arrangement stop carrying a current, one by one, and in dependency of the momentary amplitude of the rectified AC supply voltage when the momentary amplitude decreases, a second rectifier equipped with a first input terminal coupled to the first circuit input terminal via a reactive element and a second input terminal coupled to the second circuit input terminal, a second series arrangement comprising M LED loads, a first and second end of said second series arrangement being coupled to a first output terminal and a second output terminal of the second rectifier respectively, wherein M is an integer greater than zero, and a second controller for, during a period of the rectified AC voltage present between the output terminals of the second rectifier, subsequently making the LED loads comprised in the second series arrangement carry a current, one by one and in dependency of the momentary amplitude of the rectified AC voltage when the momentary amplitude increases and for subsequently making the LED comprised in the second series arrangement loads stop carrying a current, one by one, and in dependency of the momentary amplitude of the rectified AC voltage when the momentary amplitude decreases, wherein:

the first controller comprises N control strings, each of the N control strings comprising a switchable current source that electrically connects and disconnects the cathode of a different respective one of the N LED loads to the second output terminal of the first rectifier, and each of the N control strings is controlled in accordance with a signal directly received from the anode of the LED load whose cathode is electrically connected to the second output terminal of the first, rectifier through the switchable current source of the control string.

2. The LED light source according to claim 1, wherein the reactive element is a capacitor.

3. The LED light source according to claim 1, wherein the second controller comprises:

at least M−1 control strings comprising a switch and shunting M−1 of the M LED loads respectively, a control circuit coupled to the M control strings for controlling the switches comprised in the control strings, and a current source coupled between the Mth LED load and the second output terminal of the second rectifier.

4. The LED light source according to claim 1, wherein the second controller comprises M control strings, each of the control strings comprising a switchable current source that connects the cathode of a different respective one of the M LED loads to the second output terminal of the second rectifier.

5. A method for operating an LED light source equipped with a first series arrangement of N LED loads and a second series arrangement of M LED loads, where N is an integer greater than one and M is an integer greater than zero, the method comprising the steps of:

providing an AC supply voltage with frequency f, rectifying the AC supply voltage with a first rectifier, and supplying the rectified AC voltage to the series arrangement comprising N LED loads, during a period of the rectified AC supply voltage:

subsequently making, by operation of a controller, the NLED loads carry a current, one by one, in dependency of the momentary amplitude of the rectified AC supply voltage, when the momentary amplitude increases, and subsequently making the N LED loads stop carrying a current, in dependency of the momentary amplitude of the AC supply voltage, when the momentary amplitude decreases, and also the simultaneous steps of:

providing the AC supply voltage with frequency f to a second rectifier via a reactive element, rectifying the AC voltage present at the input of the second rectifier, and supplying the rectified AC voltage to the series arrangement comprising M LED loads, and during a period of the rectified AC voltage:

subsequently making the M LED loads carry a current, one by one, in dependency of the momentary amplitude of the rectified AC voltage, when the amplitude increases, and subsequently making the M LED loads stop carrying a current, in dependency of the momentary amplitude of the rectified AC voltage, when the amplitude decreases, wherein the controller comprises N control strings, each of the N control strings comprising a switchable current source that electrically connects and disconnects the cathode of a different respective one of the N LED loads to a terminal of the first rectifier, and each of the N control strings is controlled in accordance with a signal directly received from the anode of the LED load whose cathode is electrically connected to the terminal of the first rectifier through the switchable current source of the control string.

* * * * *